US008561992B2

(12) United States Patent
Huynh

(10) Patent No.: US 8,561,992 B2
(45) Date of Patent: Oct. 22, 2013

(54) METHODS OF PLAYING CARD GAMES OF STRATEGY AND CHANCE

(76) Inventor: John D. T. Huynh, Mays Landing, NJ (US)

( * ) Notice: Subject to any disclaimer, the term of this patent is extended or adjusted under 35 U.S.C. 154(b) by 159 days.

(21) Appl. No.: 12/690,575

(22) Filed: Jan. 20, 2010

(65) Prior Publication Data

US 2011/0175290 A1 Jul. 21, 2011

(51) Int. Cl.
*A63F 1/00* (2006.01)

(52) U.S. Cl.
USPC ..... 273/292

(58) Field of Classification Search
USPC ..... 273/292
See application file for complete search history.

(56) References Cited

U.S. PATENT DOCUMENTS

| | | | | |
|---|---|---|---|---|
| 5,106,100 | A * | 4/1992 | Yih | 273/306 |
| 5,718,432 | A * | 2/1998 | Fraser | 273/304 |
| 5,897,436 | A * | 4/1999 | Singer et al. | 273/293 |
| 6,227,969 | B1 * | 5/2001 | Yoseloff | 463/13 |
| 6,234,483 | B1 * | 5/2001 | Bucan | 273/292 |
| 6,247,697 | B1 * | 6/2001 | Jewett | 273/292 |
| 6,311,977 | B1 * | 11/2001 | Kulick | 273/273 |
| 6,454,265 | B1 * | 9/2002 | Elliott et al. | 273/292 |
| 6,651,984 | B1 * | 11/2003 | Luken | 273/292 |
| 6,752,393 | B2 * | 6/2004 | DiGirolamo et al. | 273/268 |
| 6,837,494 | B2 * | 1/2005 | Lee | 273/292 |
| 7,059,604 | B1 * | 6/2006 | Richards et al. | 273/292 |
| 7,484,732 | B2 * | 2/2009 | Adams | 273/157 R |
| 7,631,872 | B2 * | 12/2009 | Roemer et al. | 273/273 |
| 7,644,925 | B2 * | 1/2010 | Hughes et al. | 273/292 |
| 7,682,239 | B2 * | 3/2010 | Friedman et al. | 463/16 |
| 2004/0038720 | A1 | 2/2004 | Valente | |
| 2005/0023759 | A1 | 2/2005 | Chen et al. | |
| 2005/0098951 | A1 * | 5/2005 | Groves | 273/292 |
| 2010/0196860 | A1 * | 8/2010 | Donzow | 434/98 |

OTHER PUBLICATIONS http://www.latestcasinobonuses.com/casinos/go-fish-casino.html.*
http://boardgames.about.com/ad/cardgames/a/go_fish.htm.*
http://www.pagat.com/quartet/gofish.html.*
www.pagat.com, *Rules of Card Games: Tractor* (Jun. 24, 2009) printed on Jan. 20, 2010 from http://www.pagat.com/kt5/tractor.html, 9 pages.
www.onlinecasinogame.com, *Three Card Poker* printed on Jan. 20, 2010 from http://www.onlinecasinogame.com/poker/three-card-poker.html/, 2 pages.

(Continued)

*Primary Examiner* — Kurt Fernstrom
*Assistant Examiner* — Dolores Collins
(74) *Attorney, Agent, or Firm* — Chipperson Law Group, P.C.; Rita C. Chipperson, Esq.

(57) ABSTRACT

Methods of playing card games of strategy and chance involving both a main pot and a bonus pot and in which players may perform atypical card game actions such as robbing or killing a dragon. Players invoke events by displaying, or playing, predetermined cards or pattern combinations of cards. Players may rob the dragon, thereby requiring all other players to return played cards back to their hand. Players may kill the dragon in order to win a bonus pot. Players may also be disqualified for committing a foul. The method of the present invention also increases revenue for a house hosting the method by requiring all players to place a wager prior to viewing his or her cards and by allowing the players more opportunities to raise his or her wagers.

20 Claims, 6 Drawing Sheets

(56) References Cited

OTHER PUBLICATIONS www.pagat.com, *Rules of Card Games: Sabacc* (Oct. 8, 2005) printed on Jan. 20, 2010 from http://www.pagat.com/invented/sabacc.html, 5 pages.

www.pagat.com, *Rules of Card Games: Tarok* (*Danish*) (Mar. 5, 2008) printed on Jan. 20, 2010 from http://www.pagat.com/tarot/dantarok.html, 12 pages.

svc.bu.edu, *English Tichu Rules* printed on Jan. 20, 2010 from http://scv.bu.edu/~aarondf/Games/Tichu/Tichu.html, 6 pages.

* cited by examiner

METHODS OF PLAYING CARD GAMES OF STRATEGY AND CHANCE

BACKGROUND OF THE INVENTION

Embodiments of the present invention generally relate to methods of playing card games of strategy and chance. More specifically, the present invention relates to methods of playing card games of strategy and chance including atypical actions such as robbing or killing a dragon, wherein the methods also generate greater revenue for a house hosting the method by requiring all players to place a wager prior to viewing his or her cards and by allowing the players more opportunities to raise his or her wagers.

Various methods of playing card games of strategy and chance are known in the art. In many such games, cards are shuffled by the dealer and dealt to the players. In certain games, the players then attempt to discard the cards they have been dealt. For example, in the Uno® card game, each player attempts to remove all of his or her cards from his or her hand by placing them in a discard pile. In order for a player to discard a card, it must match the numerical value or the color of the card discarded by the previous player.

In other similar games, a player attempts to combine specific cards to create a predetermined pattern for the purpose of scoring points, discarding the cards in his or her hand, and/or creating a better combination than his or her competitors. For example, in the game of poker, each player attempts to win a hand by playing a higher ranking combination of cards than those played by the other competing players.

It also known in the art to place wagers on the outcome of card games of strategy and chance. The wagers are often placed by each player in the game. The wager is typically a sum of money, wherein the amount is determined by the players. For example, in the game of poker, each player places an initial monetary wager at the beginning of the game. During the course of play, this wager may be increased by one or more players. Any player who does not wish to increase his or her wager may withdraw from the game, or round, by returning his cards to the dealer in an act known as folding. The player who has the best combination at the end of the game is awarded the wagers.

Many card games of skill and chance are played in casinos. Some such games include Blackjack, Three Card Poker, Five Card Poker, and Texas Hold 'Em. In each of these games, the player must place a wager on the outcome of the game, wherein the amount of the wager is typically determined by the casino. The winning player is typically awarded a percentage of the wagers, wherein such percentage is typically determined by the casino. However, in some such games, such as Blackjack, if the player does not win the game, then his or her wager becomes the property of the casino. In some such games, the casino generates greater revenue as compared to those in which the winning player wins a percentage of the wagers.

BRIEF SUMMARY OF THE INVENTION

Briefly stated, in one aspect of the present invention, a method of playing a card game is provided. This method includes the following steps: receiving an initial main pot wager from each of a plurality of players; receiving an initial bonus pot wager from each of said plurality of players; dealing cards to said plurality of players in a face down manner; selecting a first player; allowing said first player to raise at least one of the group consisting of said initial main pot wager; said initial bonus pot wager; and combinations thereof; allowing each of said plurality of players other than said first player to raise at least one of the group consisting of said initial main pot wager; said initial bonus pot wager; and combinations thereof; allowing said plurality of players to view said cards; allowing said first player to become a current player and initiate a flow; allowing each subsequent player to sequentially become said current player and take a turn in said flow until either all of said players pass or one of said players holds zero cards; and initiating subsequent flows until or unless one of said players holds zero cards.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Where a term is provided in the singular, the inventors also contemplate aspects of the invention described by the plural of that term. As used in this specification and in the appended claims, the singular forms "a", "an" and "the" include plural references unless the context clearly dictates otherwise, e.g., "a card" may include a plurality of cards. Thus, for example, a reference to "a method" includes one or more methods, and/or steps of the type described herein and/or which will become apparent to those persons skilled in the art upon reading this disclosure.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods, constructs and materials are now described. All publications mentioned herein are incorporated herein by reference in their entirety. Where there are discrepancies in terms and definitions used in references that are incorporated by reference, the terms used in this application shall have the definitions given herein.

Figure 1:
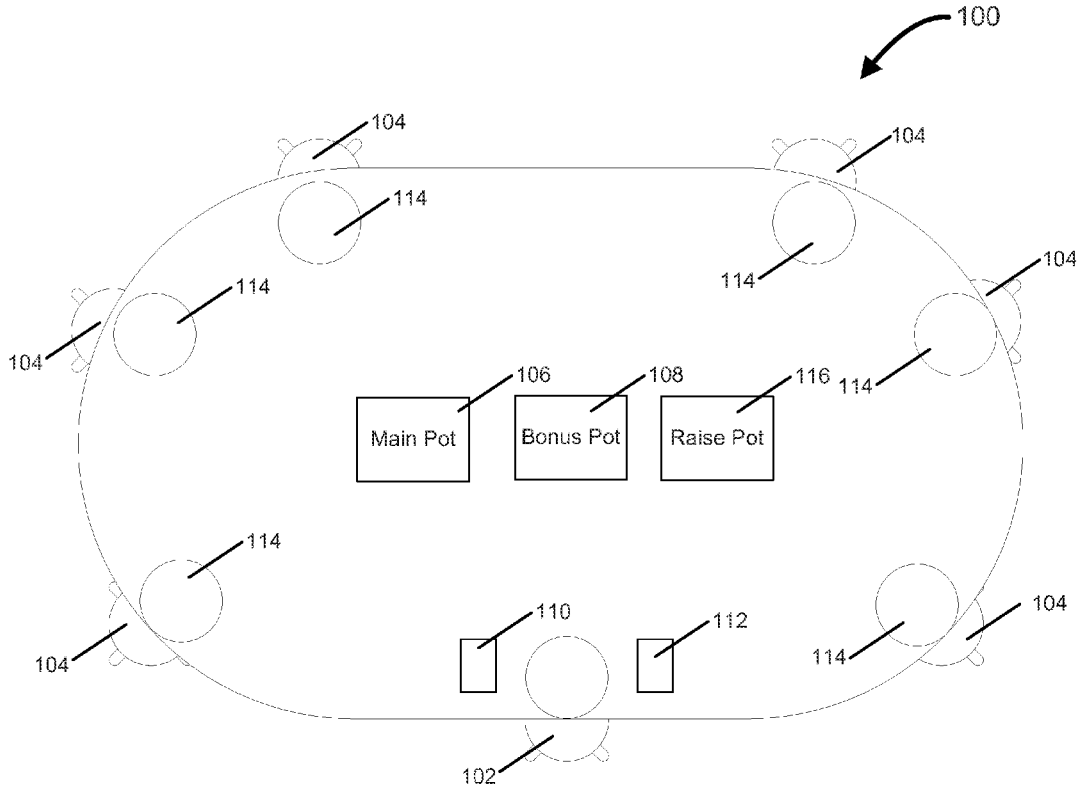
FIG. 1 is a top view of a poker table in accordance with one embodiment of the present invention.

Referring first to FIG. 1, an exemplary table 100 for a method of playing a card game in accordance with the present invention is depicted. Table 100 includes, inter alia, dealer seat 102, player seats 104, main pot location 106, bonus pot location 108, dealers' deck of cards 110, and discard pile 112. Although table 100 is depicted as having an oval shape, other shapes may be substituted without departing from the scope of the present invention. Other arrangements may also be substituted without departing from the scope hereof.

Additionally, table 100 is shown as including six player seats 104. Although six seats are shown, the game of the present invention may be played with two to six players without departing from the scope of the present invention. In the depicted embodiment, each of the players receives eight (8) cards regardless of the number of players. However, alternate embodiments of the present invention are envisioned in which each player receives a varying quantity of cards. In some such embodiments, the number of cards per player may range from three (3) to thirteen (13). In embodiments in which players receive a higher quantity of cards, the number of players may be reduced as needed below six (6) to avoid use of a second deck of cards. However, alternate embodiments of the present invention are envisioned in which more than one deck of cards may be used. Varying quantities of players and/or cards may be substituted without departing from the scope of the present invention.

Also, although table 100 is shown with a dealer seat 102, embodiments of the present invention are envisioned in which one of the players performs the functions of the dealer in lieu of an independent dealer. Also, in a two player game, one of the two players may be the dealer. Additionally, the other elements of table 100 are discussed in greater detail below in relation to the flowcharts of FIGS. 2A through 2D.

Figure 2A:
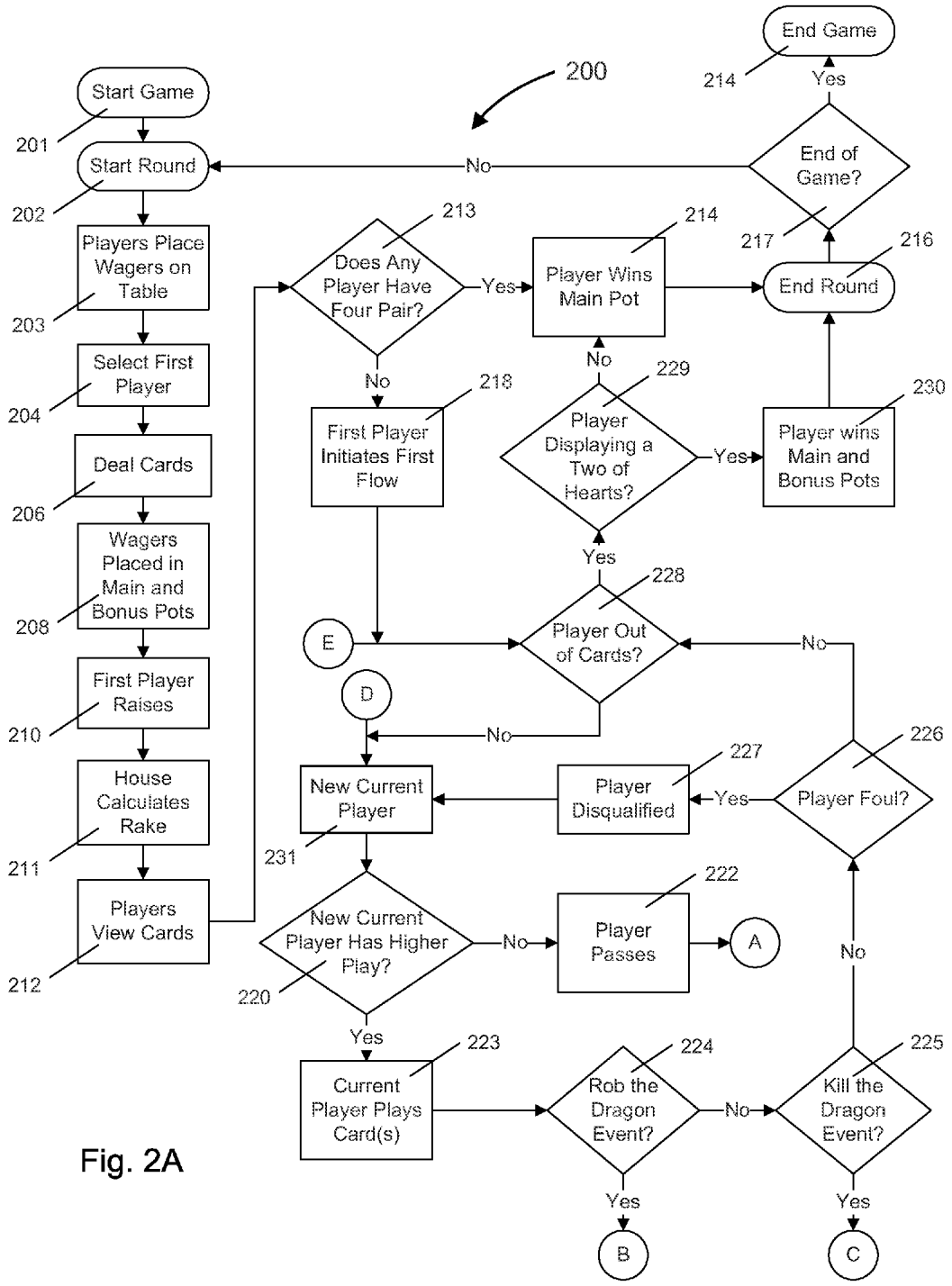
FIGS. 2A-2D depict a flowchart of the steps of a process for playing a card game of strategy and chance in accordance with one embodiment of the present invention.

Turning now to FIG. 2A, illustrated is an exemplary method of playing a card game in accordance with one embodiment of the present invention. Process 200 begins at 201, at which a game begins. Process 200 then proceeds to 202, at which a first round of play begins. Each game is composed of a plurality of rounds. The number of rounds is determined by events that take place in the game as further discussed below.

Next, at 203, each player (e.g., players seated in player seats 104) places a wager in player display area 114 for each of the two pots, namely, the main pot and the bonus pot. In some embodiments of the invention, the wagers are a predetermined amount or they are required to be within a predetermined range. This amount or range may be specified by any entity, however, it is envisioned that they will be set by the establishment hosting the game (e.g., a casino) or one or more players of the game. That is, in some embodiments, each player is required to contribute the same initial wager of a predetermined value to the main pot and/or the bonus pot. Or, in an alternative embodiment, each player may contribute differing wagers without departing from the scope of the present invention.

The main pot and bonus pot are accumulations of money that represents the total of the monetary wagers that are stake at any given time. The main pot and the bonus pot are created when the dealer places each player's main and bonus wagers in a predetermined location, for example, in the main pot location 106 and the bonus pot location 108, respectively, of exemplary table 100 as depicted in FIG. 1. In the exemplary embodiment of the present invention depicted in FIGS. 2A through 2D, all players are required to contribute to both pots at the start of a round. However, this is not required to implement the method of the present invention. For example, in an alternative embodiment, the bonus pot may be eliminated and/or players may contribute to either pot at a time other than the start of a round. In yet another alternative, one or more pots may be eliminated without departing from the scope of the present invention.

The main pot is awarded to the player who wins the round at the conclusion of the round. The bonus pot is only awarded in specific circumstances, which are further discussed below. Therefore, unlike the main pot, the bonus pot is carried over from round to round and its value may increase as multiple rounds are played.

In the embodiment of the present invention depicted in FIGS. 2A through 2D, an individual wishing to join the game after the first round of play may select one of two options for his or her contribution to the bonus pot. First, an individual may become eligible to win the entire bonus pot by contributing an amount of money equal to the amount contributed to the current bonus pot by each player per round multiplied by the number of rounds that have occurred since a player won the bonus pot. For example, if the bonus pot has not been awarded for three rounds, then the player wishing to join the game has the option of wagering an amount equal to what they would have wagered if they had participated in all three previous rounds plus the wager for the current round.

Alternatively, a player wishing to join the game can become eligible to win a percentage of the bonus pot (in lieu of the entire bonus pot) by wagering an amount equal to the required bonus pot wager for that round. In this scenario, if this new player wins the bonus pot, the player would only receive a portion of the bonus pot. For example, if it takes six rounds to win the bonus pot and the new player only added wagers to the bonus pot in three of the six rounds, the player may win fifty (50) percent of the bonus pot. In the event that one or more players join after the first round and contribute partial wagers to the bonus pot, the dealer may elect to place the partial wagers in a separate location (e.g., a side pot) in order to more easily allocate the winnings when the bonus pot is awarded. However, alternate methods of apportioning and/or tracking some or all of the bonus pot may be substituted without departing from the scope of the present invention.

Additionally, a player may elect to leave the game at the end of a round before a new round begins even if the bonus pot has not been awarded and it includes the player's bonus pot wager(s). In this scenario, the player loses all of his or her wagers contributed to the current bonus pot. If a player leaves the game and forfeits his or her wagers, then all other players become eligible to win the forfeited wagers. In the example discussed above, if a player who contributed wagers for all rounds from the start of the game leaves the game, then the other players become eligible to win the wagers abandoned by the original player. One exception to this would be the excusing of the player for a bathroom break. Such breaks would typically be limited in duration. For example, such breaks may be limited to two (2) minutes or some alternate time without departing from the scope of the present invention. The establishment hosting the game earns a greater commission by not allowing refunds of bonus pot wagers because the hosting establishment cannot earn a commission on a refunded wager. That is, when a wager is refunded to a player, the casino does not earn a commission on the refunded amount. However, if the wager is forfeited by the original contributor but is then later awarded to another player, the hosting establishment earns its regular commission on this amount as further discussed below with respect to FIGS. 3A-3D.

After the players place their wagers in player display area 114, process 200 proceeds to 204, at which the player who will take the first turn (i.e., the first player) in the round is selected. In one embodiment of the present invention, the first player is selected via a random number generator ("RNG"). This can be any RNG commonly known in the art. For example, if there are five players, each player is assigned a number between one and five, and the dealer would use the RNG to select a number between one and five. The player that corresponds to the number selected by the RNG is designated to take the first turn. In a round in which there is only one player 104, the dealer 102 acts as a player and he or she may also be selected to take the first turn. Although the depicted embodiment of the present invention utilizes a RNG, other methods of selecting the first player may be substituted without departing from the scope of the present invention.

Next at 206, the cards are dealt. The cards are dealt from a standard fifty-two (52) card deck. Each player receives eight (8) cards. If there is only one player, then the dealer also receives eight (8) cards. When there is only one player, the dealer participates in the game in the same manner as any other player with a few exceptions as described in detail herein. The dealer places the cards face down on the table in front of each person participating in the round starting with the first player selected in step 204. After all of the required cards have been dealt, any remaining cards are placed in the dealers' deck of cards (e.g., dealers' deck of cards 110). Although each player receives eight (8) cards in the exemplary embodiment depicted in FIGS. 2A through 2D, a varying quantity of cards may be substituted without departing from the scope of the present invention.

Next at 208, the dealer collects wagers for the main and bonus pot from each player. That is, each player gives the main pot wager and bonus pot wager stored the in player display area 114 to the dealer. The dealer then places the wagers in designated locations such as main pot location 106 and bonus pot location 108.

Process 200 then proceeds to step 210, at which the selected first player may raise the wagers in the main and/or bonus pots. That is, the first player may elect to contribute additional wagers to the main pot and/or bonus pot beyond the initial wagers. In the embodiment of the present invention depicted in FIGS. 2A through 2D, the main pot raise and the bonus pot raise may be any amount from zero up to three times the table limit. The table limit defines the minimum and maximum allowed initial wagers. The casino sets the table limit in order to maximize the revenue that they receive from the game. For example, if a table has a table limit of fifty dollars, then the initial wager must be either fifty (50) dollars or some other range having a maximum of fifty (50) dollars as defined by the casino. In this example, the maximum raise would be three times the table limit, or one hundred fifty (150) dollars. However, other acceptable raise values may be substituted without departing from the scope of the present invention. In addition, the main pot raise and bonus pot may have different limits and/or one or more of the raises may be unlimited.

If the selected first player elects to raise the main pot wager and/or the bonus pot wager, then the first player adds the amount of the raise to the raise pot 116. The raise pot 116 is an accumulation of money that represents the total monetary raise wagers that are at stake at a given time. The raise pot 116 includes two subtotals; the main pot raise and the bonus pot raise. All other players participating in the current round must also determine whether to raise their main pot wager and/or bonus pot wager. Wagers are made in the same manner in which players will play their cards. For example, in one embodiment, wagers and play proceed clockwise around the table. After the current player has placed a wager or played his or her cards, the player seated to the left of the current player becomes the new current player. The current player then places his or her wager or plays his or her cards, respectively. However, alternate embodiments are envisioned in which play proceeds counterclockwise around the table. Once all players have been provided with the opportunity to raise his or her bet, the first player is again provided with an opportunity to raise. Thereafter, each of the other players also has the opportunity to re-raise his or her bets. This process continues until none of the players wish to raise his or her bets. However, alternate embodiments are envisioned in which each player is only provided a limited quantity of raises (e.g. one, two, etc.) without departing from the scope of the present invention.

The wager placed by the current player may be any amount up to three times the table limit regardless of the amount raised by the selected first player. That is, the current player may elect to raise the main pot wager and/or bonus pot wager by an amount smaller or greater than that raised by the selected first player. If a player does not elect to raise their wagers, then that player may still participate in the round. Alternatively, embodiments of the present invention are envisioned in which all players are required to raise their wagers to participate in a round if a preceding player has raised his or her wager. In yet another embodiment of the present invention, all players are required to raise their wagers to an amount equal to the amount by which the preceding player has raised his or her wager.

Next, process 200 proceeds to 211, at which the house rake is calculated. The house rake is a monetary amount charged by the establishment hosting the game. A house rake will typically be charged when the game is played in a casino or similar environment; however, it is not necessary to implement the methods of the present invention. It is anticipated that the house rake for the present invention will be greater than the house rake generated for a standard poker game because the present invention requires each player to place a wager before the player views his or her cards. That is, unlike traditional poker games, a player cannot fold without placing an initial wager. Additionally, the present invention allows each player to contribute an additional wager (i.e., a raise) to one or both pots at the start of each round. This should generate a higher house rake because the house takes a percentage of all raises. In some embodiments of the present invention, the hosting establishment may generate a greater house rake by giving players the opportunity to further increase their wager while a round is in progress. That is, allowing each player to raise their wager at some time after step 210 can generate a greater house rake. In such an event, the house rake may be recalculated at any time as necessary.

In the embodiment of the present invention depicted in FIGS. 2A through 2D, the house rake is the sum of three separate house rakes (i.e., the main pot rake, the bonus pot rake, and the raise rake) as depicted in FIGS. 3A through 3D. The main pot rake is calculated by summing the main pot wagers 302 of each player. In this example, each of six players contribute fifty (50) dollars to the main pot, which sums to a main pot total 306 of three hundred (300) dollars. The main pot rake 312 is then calculated by multiplying the main pot total 306 by the main pot rake percentage 310. In this example, the main pot rake percentage 310 is five (5) percent. Therefore, the main pot rake 312 is calculated to be fifteen (15) dollars by multiplying the main pot total 306 (i.e., $300.00) by the main pot rake percentage 310 (i.e., 5%).

Figure 3A:
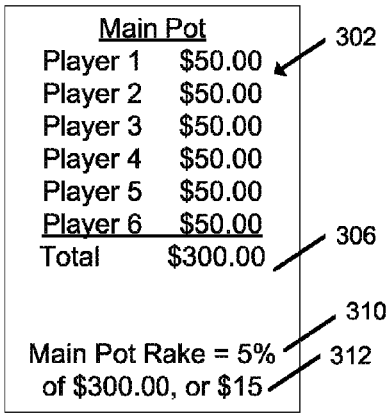
FIGS. 3A-3D depict one method of calculating a house rake for in accordance with one embodiment of the present invention.
Figure 3B:
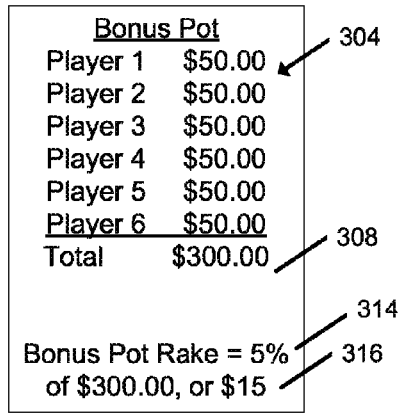

The bonus pot rake, depicted in FIG. 3B, is calculated by first summing the bonus pot wagers 304 of each player. In this example, each of six players contributed fifty (50) dollars which sums to a bonus pot total 308 of three hundred (300) dollars. The bonus pot rake 316 is then calculated by multiplying the bonus pot total 308 by the bonus pot rake percentage 314. In this example, the bonus pot rake percentage 314 is five (5) percent. Therefore, the bonus pot rake 316 is calculated to be fifteen (15) dollars by multiplying the bonus pot total 308 (i.e., $300.00) by the bonus pot rake percentage 314 (i.e., 5%).

Figure 3C:
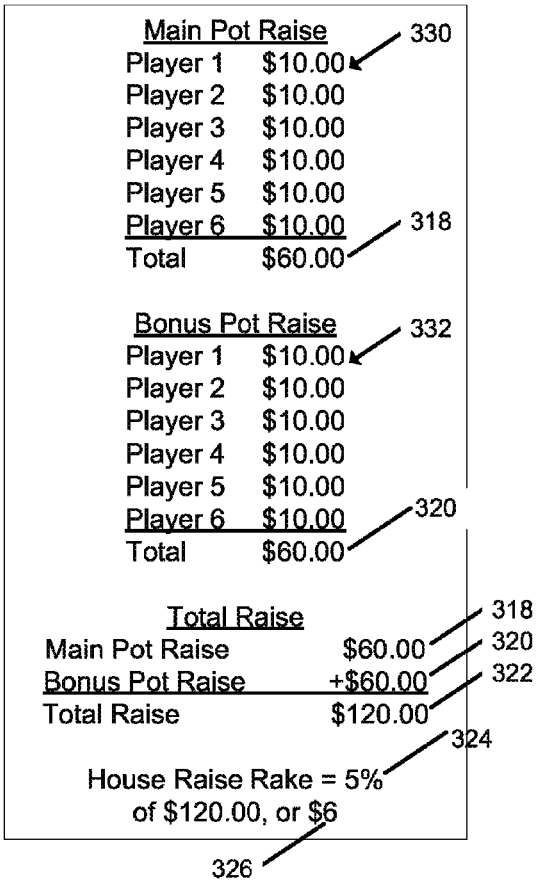

The raise rake, as depicted in FIG. 3C, is calculated by summing the raise wagers of each player for the main and bonus pots. In this example, each of six players contributed a main pot raise 330 of ten (10) dollars which sums to a total main pot raise 318 of sixty (60) dollars. Each player additionally made a bonus pot raise 332 of ten (10) dollars. The total bonus pot raise 320 wagered by all six players is sixty (60) dollars. The total raise 322 is the sum of these two amounts, or one hundred twenty (120) dollars. The raise rake 326 is then calculated by multiplying the total raise 322 by the raise rake percentage 324. In this example, the raise rake percentage 324 is five (5) percent. Therefore, the raise rake is calculated to be six (6) dollars by multiplying the total raise 322 by the raise rake percentage 324 (i.e., 5%).

Figure 3D:
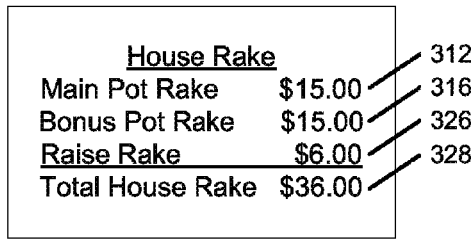

The total house rake, as depicted in FIG. 3D, is calculated by summing the main pot rake 312, the bonus pot rake 316, and the raise rake 326. Therefore, the total house rake 328 is calculated to be thirty-six (36) dollars by summing the main pot rake (i.e., $15), the bonus pot rake (i.e., $15), and the raise rake (i.e., $6). However, other methods of calculating the house rake, if any, may be substituted. For example, the house rake may be the sum of a per round charge paid by each player. After the house rake is calculated, process 200 proceeds to step 212.

At step 212, the players are allowed to view their cards for the first time in the round. However, alternate embodiments are envisioned in which the players are allowed to view their cards earlier or later in the game. For example, players may be allowed to view their cards prior to determining whether to raise. However, such an embodiment may decrease the revenue generated by the house, if any.

Next, at step 213, any player holding four consecutive pairs in his or her hand has the opportunity to declare it and display his or her hand to the other players. Four consecutive pairs is defined below. Any player who declares four consecutive pairs and who is confirmed to be holding four consecutive pairs in his or her hand automatically wins the round. Process 200 then proceeds to step 214, at which the winning player is awarded the money in the main pot. The round then ends at 216.

Next, process 200 proceeds to 217 at which it is determined whether the end of the game has been reached. In the embodiment of the present invention depicted in FIGS. 2A through 2D, the end of the game is reached after the bonus pot is awarded. During the game, an event resulting in the bonus pot being awarded typically occurs after an average of six rounds. However, the bonus pot can be awarded during any round without departing from the scope of the present invention, including, but not limited to, the first round of play. At this point, the game ends because the bonus pot has been awarded.

In the event that only a portion of the bonus pot is awarded as further discussed above, then the portion of the bonus pot that remains unawarded is held by the hosting establishment and the game continues until a new winner wins the remaining bonus pot. The portion of the bonus pot that each player is eligible to win does not change at this point in the game unless a player leaves the table and forfeits his or her wagers. However, the game may conclude after a specific quantity of rounds or based upon some other event without departing from the scope of the present invention. If the game is determined to have ended, process 200 proceeds to 219 at which the game ends. Alternatively, if the game has not ended, process 200 returns to 202 at which a new round of play begins as described above.

Alternatively, if, at 213, no player is holding four consecutive pairs, then process 200 proceeds to 218, at which the selected first player places one or more cards in the player's display area such that the face of the cards are visible to the other players. In the exemplary table depicted in FIG. 1, player display area 114 is located directly in front of the player on the surface of table 100. In such an embodiment of the invention, the player places his or her cards face up on the portion of the table located directly in front of the player. However, varying locations for a player display area may be substituted without departing from the scope of the present invention.

The card(s) to be placed in the player display area (i.e., the displayed cards) are strategically selected by the first player based upon the totality of the cards in the first player's hand and the possible "pattern" combinations that may be made with such cards. A pattern combination of cards is a predetermined combination of cards in accordance with the rules of the game. These predetermined combinations determine the manner in which each player is allowed to remove cards from his or her hand for placement in the player's respective card display area. Since one method of winning a round of the game is to be the player that first disposes of all of the cards in his or her hand, one strategy involved in the game is to determine which combinations, and which order of displaying such combinations, will maximize the player's chance for disposing of all of his or her cards and/or otherwise winning the round. That is, the selected first player strategically chooses to initially display a card or a pattern of cards that will maximize their chance of disposing of all cards in his or her hand before any other player disposes of the cards in his or her hand.

Additional strategy may be involved when the first player determines which card or pattern combination of cards to initially display as this display initiates a first "flow" of the round and it determines what cards or pattern combinations of cards may be displayed by the other players during that flow. That is, once a card or pattern combination of cards is displayed or played by the first player, all cards or pattern combinations played by subsequent players must be the same pattern. A flow is the display of cards or pattern combinations of cards by any player that occurs after the initial display of a card or a pattern combination of cards by the first player. A flow begins with the initial display of a card or a pattern combination of cards by the first player and it continues until either: 1) a player disposes of all cards in his or her hand; or 2) none of the players is able to display a card or a pattern combination of cards based upon the previously displayed cards.

In accordance with the embodiment of the present invention depicted in FIGS. 2A through 2D, a decreasing value hierarchy is assigned to each suit of cards in a standard fifty-two (52) card deck as follows: 2, A, K, Q, J, 10-3. Additionally, a decreasing hierarchy based upon suit is as follows: hearts, diamonds, clubs, and spades. During play, each current player must display a combination of a higher value hierarchy. It should be noted that varying value and suit hierarchies may be substituted without departing from the scope of the present invention.

In addition to the hierarchies based upon suit and value, the following pattern combinations exist: a) Straight Flush (i.e., at least three cards of the same suit in the value order defined above); b) Flush (i.e., at least three cards of the same suit); c) Straight (i.e., at least three cards in the value order defined above); d) Three of a Kind (i.e., three cards of the same value); e) Pair (i.e., two cards of the same value); f) Two Consecutive Pairs (i.e., two pairs with adjacent values in the numerical value order defined above); g) Single Card (i.e., any one card regardless of value or suit); h) Three Consecutive Pairs (i.e., three pairs with adjacent values in the numerical value order defined above); i) Four Consecutive Pairs (i.e., four pairs with adjacent values in the numerical value order defined above); j) Two Consecutive Three of a Kind (i.e., two three of a kind with adjacent values in the numerical value order defined above); and k) Four of a Kind (i.e., four cards of the same value). However, varying embodiments of the present invention are envisioned with differing pattern combinations.

It should be noted that in the embodiment of the present invention depicted in FIGS. 1 through 3, the lowest possible value of the lowest card in a straight flush is three (3) and the highest possible value of the highest card in a straight flush is two (2). That is, a straight flush in the form of A-2-3 or 2-3-4 is not permissible because there can be no looping of the value hierarchy. However, alternate embodiments of the present invention are envisioned in which such looping is permissible without departing from the scope of the present invention.

Next, process 200 proceeds to step 228, at which the current player's cards are queried to determine if there are any cards left in the current player's hand. If no, process 200 proceeds to step 229. Step 229 queries the cards displayed by the winner of the round (i.e., the first player to dispose of all cards in his or her hand) to determine if the winning player displayed, or played, a card with a value of two (2) and a suit of hearts. If no, process 200 proceeds to step 214, at which process 200 proceeds as discussed above for step 214. Alternatively, if the player is displaying a card with a value of two (2) and a suit of hearts, then process 200 proceeds to step 226, at which the player is awarded all or a portion of both the main pot and the bonus pot. Process 200 then proceeds to 216, at which it proceeds as discussed above for step 216.

Alternatively, if, at step 228, the current player still holds cards in his or her hand, process 200 proceeds to step 231 at which a new player becomes the current player and takes his or her turn. In one embodiment of the present invention, play passes from player to player based upon a clockwise rotation around the table. However, other methods of determining the turn of each player may be substituted without departing from the scope of the present invention including, but not limited to, counterclockwise rotation.

Next, at step 220, the new current player determines whether he or she has a higher value card or pattern combination of cards than that played by the previous player. In accordance with the rules of the game, cards to be displayed, or played, by a current player must have a higher ranking (as determined based upon the hierarchy discussed above) than the cards played by the previous player. Additionally, if a pattern combination of cards was previously displayed, or played, the subsequent player must display a pattern combination of cards having the same pattern and having a higher ranking. For example, if the previous player displays two consecutive pairs, then the subsequent player must display two consecutive pairs having a higher rank. In this exemplary instance, the higher ranking two consecutive pairs may be: 1) two consecutive pairs having the same value as the previously played two consecutive pairs but a higher suit ranking; 2) two consecutive pairs having a higher value than the previously played two consecutive pairs and the same suit; or 3) two consecutive pairs having a higher value and a higher ranking suit than the previously played two consecutive pairs.

When determining if a pattern combination of cards is higher in rank than a previously played pattern combination of cards, the highest ranking cards of each combination are compared regardless of the rank of any lower ranking or intervening cards. For example, if the previously played pattern combination of cards is two consecutive pairs and it includes a five (5) of spades, a five (5) of hearts, a four (4) of clubs, and a four (4) of diamonds, then a subsequent player would be unable to play a five (5) of diamonds, a five (5) of clubs, a four (4) of hearts, and a four (4) of diamonds. The subsequent player does not have a higher ranking pattern combination of cards because the highest ranking card of the previously played pattern is a five (5) of hearts and the highest ranking card of the subsequent player's cards is a five (5) of diamonds and a suit of hearts ranks higher than a suit of diamonds. Therefore, the two consecutive pairs played by the previous player ranks higher than the two consecutive pairs in the hand of the subsequent player. It is irrelevant that the subsequent player's consecutive pair of fours has a higher rank than the previously played pair of fours. That is, in this example, the five (5) of hearts and the five (5) of diamonds are the highest ranking card of each pattern combination of cards and it is these cards that are compared when making the determination of rank. The card whose suit is a heart ranks higher than the card whose suit is a diamond. In this scenario, the current player is required to choose a different higher ranking pattern combination of cards or to pass (as discussed below).

Figure 2B:
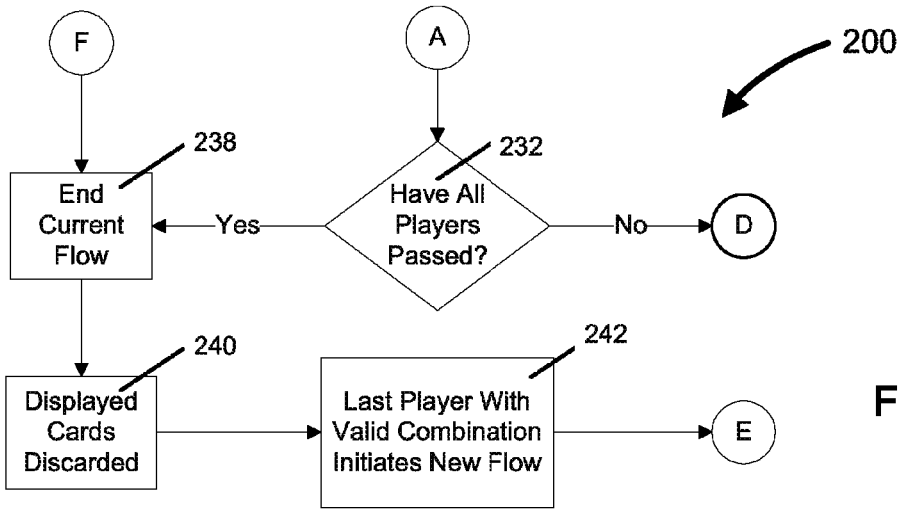

At 220, if the current player does not possess a higher ranking card or pattern combination of cards in his or her hand, then method 200 proceeds to 222, at which the current player must announce a "pass" and method 200 continues as depicted in FIG. 2B as further discussed below. However, process 200 will also proceed to 220 if the current player has a higher ranking card or pattern combination of cards in his or her hand but chooses to pass for strategic reasons. That is, if the current player possesses a higher ranking card or pattern combination of cards in his or her hand but does not wish to play the card or combination at that time, he or she may elect to pass even though he or she could display, or play, cards. For example, the current player may elect to pass even though he or she possesses a higher ranking card or combination if the player believes that one or more of the higher ranking cards or combination of cards could be better used at a later time (e.g., in a later flow) standalone or in a different pattern combination of cards. This exemplary scenario may occur, for example, if the higher ranking pattern combination of cards is a pair of fours (4), one being a spade and one being a diamond, but the current player is also holding three other cards of the diamond suit in his or her hand. In this example, the player may elect to pass in order to retain the four of diamonds to maintain the chance of potentially displaying a Flush. One exception to this rule occurs when there is only one player other than the dealer 102. In this scenario, the dealer may not elect to refrain from playing a higher ranking card or pattern combination of cards if it is in his or her hand regardless of any potential advantage that may be gained. However, alternate embodiments of the present invention are envisioned in which the dealer may pass rather than playing a higher ranking card or pattern combination of cards.

If, at 222, the current player passes, then he or she may not play any other cards or pattern combination of cards for the remainder of the current flow. After the current flow has ended and a subsequent flow has begun, the passing player may again participate.

Alternatively, if at step 220, the current player elects to play a higher ranking card or pattern combination of cards, then method 200 proceeds to 223, at which the cards are displayed, or played, in the player's card display area. The played card or combination of cards may be any that rank higher than the cards or combination played by the previous player.

Next, method 200 proceeds to step 224, at which it is determined if a "Rob the Dragon" event has occurred. A "Rob the Dragon" event takes place when a player plays one of a set of predetermined pattern combinations of cards. In the embodiment of the present invention depicted in FIGS. 2A through 2D, the predetermined Rob the Dragon pattern combinations of cards include Three Consecutive Pairs or Two Consecutive Three of a Kind, both of which are defined above. However, alternate Rob the Dragon pattern combinations of cards may be substituted without departing from the scope of the present invention.

Figure 2C:
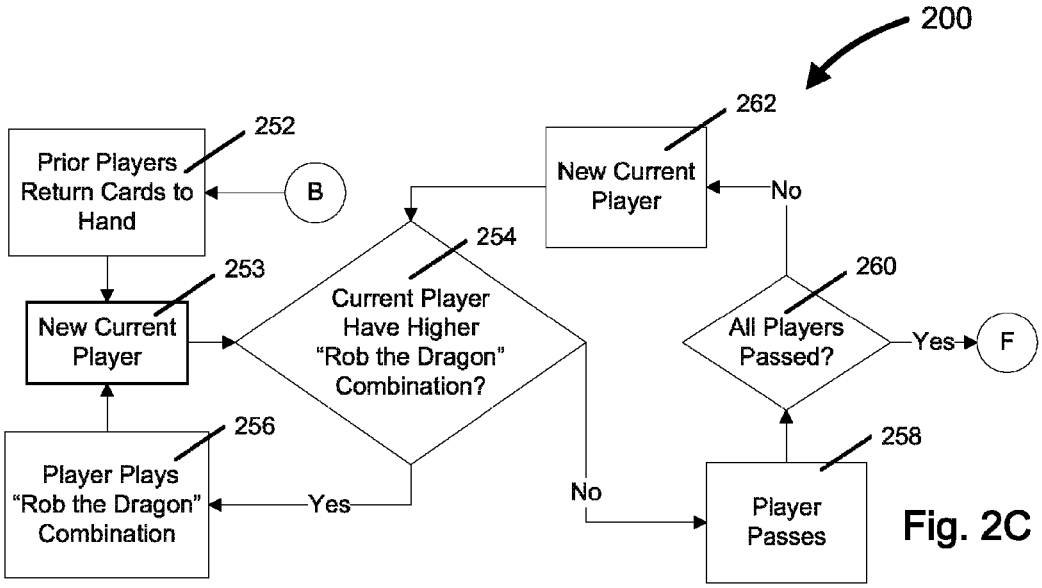

If, at 224, the current player has played a Rob the Dragon pattern combination of cards, then a Rob the Dragon event has occurred and method 200 proceeds to step 252 as depicted in FIG. 2C and as discussed in greater detail below.

Figure 2D:
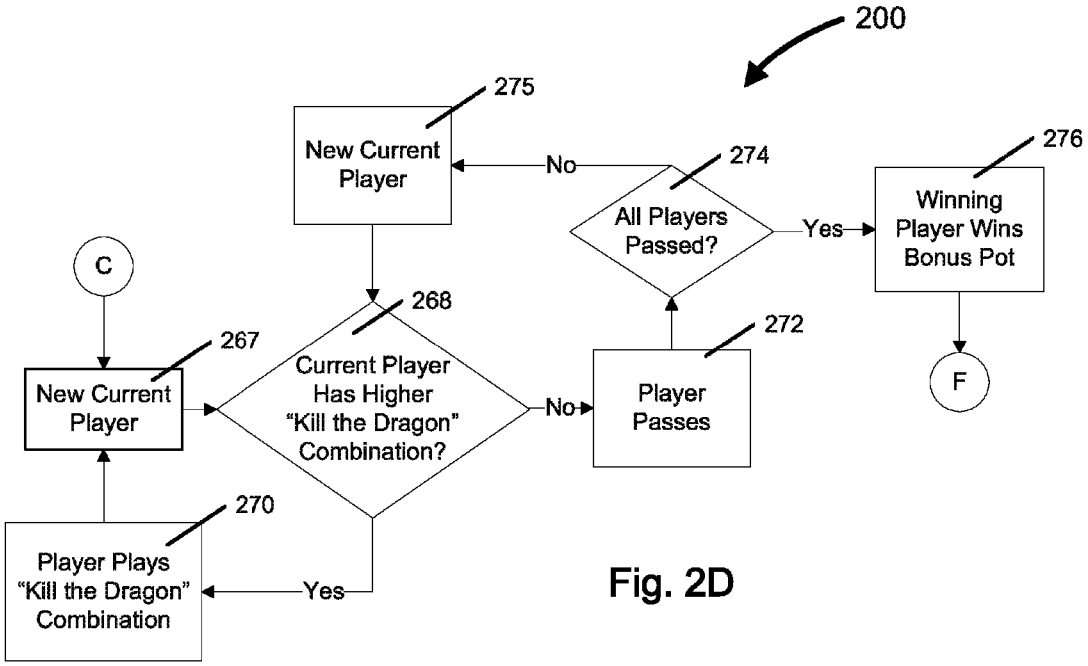

Alternatively, if a Rob the Dragon event has not occurred, method 200 proceeds to step 225, at which it is determined if a "Kill the Dragon" event has occurred. A "Kill the Dragon" event takes place when the current player plays a specific predetermined pattern combination of cards at a specific point in the game. If the previous player played a single two (2) of any suit and the current player plays a Four of a Kind of any suit as defined above, then a Kill the Dragon event has occurred and method 200 proceeds to step 267 as depicted in FIG. 2D and as discussed in greater detail below. If a Kill the Dragon event has not occurred, then method 200 proceeds to step 226.

Step 226 determines if a player foul has occurred. A player "fouls" and is disqualified from participating in the remainder of the round if he or she plays an invalid combination of cards. An invalid combination is any combination of cards that does not follow the pattern established for the current flow, or is not a higher ranking card or combination of cards. For example, if the previous player played a pair of threes (3), one of hearts and one of spades, and the current player plays a pair of threes (3), one of diamonds and one of clubs, then the current player has committed a foul. The reason for this is that, in this exemplary instance, the three (3) of hearts played by the previous player is higher in rank than both the three (3) of diamonds and the three (3) of clubs played by the current player. Since the pattern combination of cards played by the current player is not higher than that played by the previous player, it is considered invalid. A player may also "foul" by placing card(s) in the player's display area, changing his or her mind, and retrieving the card(s) for placement back into the player's hand.

If, at 226, the current player has committed a foul, process 200 proceeds to step 227, at which the player is disqualified. A disqualified player may not participate in the current flow or any subsequent flows for the round. After the current round is completed, the player may participate in following rounds. The player who commits the foul, therefore, loses his or her main pot wager as the main pot is awarded at the end of the current round. However, the bonus pot wager of the player who commits the foul is preserved and remains valid for the next round unless the Bonus pot is awarded during the round in which the player is disqualified.

Alternatively, if, at 226, the current player has not fouled, method 200 returns to step 228 as discussed in detail above. If, at step 222, the current player passes, then method 200 proceeds to step 232 as depicted in FIG. 2B. At step 232, a determination is made as to whether all players participating in the current round have passed for the current flow. If any one of the player has not passed, then method 200 returns to step 231, at which a new player takes his or her turn and method 200 proceeds as described in detail above.

Alternatively, if, at step 232, all players have passed, then method 200 proceeds to step 238. At step 238, the current flow ends and method 200 proceeds to step 240, at which all cards displayed or played by the players during the course of the just ended flow are placed in a discard pile such as discard pile 112 (FIG. 1). The cards remaining in the players' hands or reshuffled and re-dealt. Therefore, when a new flow is initiated, each player who displayed or played cards during the previous flow will have fewer cards. The quantity of cards will be equal to the total cards received by each player at the beginning of the previous round minus any cards displayed, or played, by the player in the previous round.

Next, at step 242, the last player to display, or play, a valid card or pattern combination of cards during the previous flow initiates the new flow with any valid card combination and establishes the pattern for the new flow. Method 200 then returns to step 228 and proceeds as discussed in greater detail above.

As discussed above, step 224 determines whether a Rob the Dragon event has occurred. If yes, process 200 proceeds to 252 as depicted in FIG. 2C. At step 252, all players (other than the one who is "robbing the dragon") who have displayed cards during the current flow prior to the Rob the Dragon event must retrieve the displayed cards and return them to their respective hands. However, the player who is robbing the dragon (i.e., the one who played the Rob the Dragon combination) does not return any displayed cards to his or her hand.

Next, process 200 proceeds to step 253, at which the next player takes his or her turn and becomes the new current player. Next, at 254, the current player may check his or her hand to determine if he or she has a higher ranking Rob the Dragon pattern combination of cards. If yes, process 200 proceeds to step 256, at which the higher ranking Rob the Dragon pattern combination of cards is displayed, or played. Process 200 then returns to step 254 and repeats the loop until the new current player does not possess a higher ranking Rob the Dragon pattern combination of cards, at which point process 200 proceeds to 258. At 258, the current player passes. Method 200 then proceeds to step 260, at which it is determined if all of the players have passed.

If players remain who have not yet passed, method 200 proceeds to step 262 at which a new player becomes the current player. Next, at 254, it is determined whether the current player possesses a higher ranking Rob the Dragon pattern combination of cards. If yes, process 200 proceeds to 256 at which the current player plays his or her Rob the Dragon pattern combination of cards. This loop repeats until all players have passed and process 200 proceeds to step 238 as further discussed above. Alternatively, if, at 260, all players have passed, then process 200 proceeds to 238 as depicted in FIG. 2B and as discussed in greater detail above.

As also discussed above, step 225 determines whether a Kill the Dragon event has occurred. If yes, process 200 proceeds to 267, as depicted in FIG. 2D. At step 267, the next player takes his or her turn and becomes the new current player. Next, at step 268, the new current player may check his or her hand to determine if he or she has a higher ranking Kill the Dragon pattern combination of cards. If yes, process 200 proceeds to step 270, at which the higher ranking Kill the Dragon pattern combination of cards is displayed, or played. Process 200 then returns to step 268 and repeats the loop until the current player does not possess a higher ranking Kill the Dragon pattern combination of cards, at which point process 200 proceeds to 272, at which the current player passes. Method 200 then proceeds to step 274, at which it is determined if all of the players have passed.

If players remain who have not yet passed, method 200 proceeds to step 275 at which a new player becomes the current player. Next, at 268, it is determined whether the current player possesses a higher ranking Kill the Dragon pattern combination of cards. If yes, process 200 proceeds to 270 at which the current player plays his or her Kill the Dragon pattern combination of cards. This loop repeats until all players have passed and process 200 proceeds to 276.

Alternatively, if all players have passed, then process 200 proceeds to 276, at which the player who played the highest ranking Kill the Dragon pattern combination of cards is awarded some or all of the bonus pot. Method 200 then returns to 238 as depicted in FIG. 2B and proceeds as discussed in greater detail above.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A method of playing a table card game comprising the steps of:

(a) providing the following components of a table card game:

a game table, said game table including two or more player display areas, each of said player display areas associated with two or more players, a main pot location, a bonus pot location, a raise pot location, a dealer card deck location, and a discard pile location;

a plurality of cards;

(b) receiving an initial main pot wager in each of said player display areas from each of said players;

(c) receiving an initial bonus pot wager in each of said player display areas from each of said players;

(d) moving said initial main pot wager from each of said player display areas to said main pot location;

(e) moving said initial bonus pot wager from each of said player display areas to said bonus pot location;

(f) selecting a first player;

(g) dealing a predetermined quantity of said plurality of cards to each of said player display areas in a face down manner;

(h) placing undealt ones of said plurality of cards in said dealer card deck location;

(i) allowing said players to view said predetermined quantity of said plurality of cards located in a respective one of said player display areas;

(j) initiating a wagering round by allowing said first player to perform a main pot raise by placing said main pot raise in said raise pot location;

(k) allowing each of said players to sequentially perform a subsequent main pot raise by placing said subsequent main pot raise in said raise pot location;

(l) allowing said first player to become a current player and initiate a flow by placing an initial pattern of one or more of said plurality of cards in said player display area of said first player;

(m) allowing each of said players to sequentially become said current player;

(n) allowing said current player to pass or place an allowed higher ranking pattern in said player display area of said current player;

(o) continuing said flow until all of said players pass or one of said players holds zero of said plurality of cards;

(p) repeating steps (f) through (o) until one of said players holds zero of said plurality of cards; and (q) declaring said one of said players holding zero of said plurality of cards as a winner of said table card game.

2. A method according to claim 1 further comprising:

allowing any of said players to place a predetermined winning pattern of said plurality of cards in said player display area of said player.

3. A method according to claim 2, wherein said predetermined winning pattern is four pairs of said plurality of cards.

4. A method according to claim 1 further comprising:

allowing said current player to perform at least one of the group consisting of robbing the dragon, killing the dragon, and combinations thereof.

5. A method according to claim 1 further comprising:

initiating subsequent ones of said flows until a predetermined number of said flows have been played.

6. A method according to claim 1, wherein said components of a table game include a random number generator.

7. A method according to claim 6, wherein said selecting a first player is performed via use of said random number generator.

8. A method according to claim 1, wherein said first player in a subsequent one of said flows is selected from the group consisting of said player placing a last pattern in said player display area of said player during a previous one of said flows and a sequentially subsequent one of said players as determined by a last player of said previous one of said flows.

9. A method according to claim 1, wherein said predetermined quantity is eight.

10. A method according to claim 1, wherein a maximum value of said main pot raise is a predetermined table limit multiplied by three.

11. A method according to claim 1 further comprising:

repeating steps (j) and (k) until all of said players have performed all desired ones of said main pot raises.

12. A method according to claim 1 further comprising:

awarding at least one of the group consisting of said main pot, said bonus pot, and combinations thereof to said winning player.

13. A method according to claim 1, wherein said plurality of cards includes one or more standard fifty-two card decks.

14. A method according to claim 1, wherein each of said plurality of cards is ranked by numerical value and suit.

15. A method according to claim 1, wherein:

said winning player is awarded a main pot from said main pot location; and said winning player is awarded a bonus pot from said bonus pot location if said winning player displayed a predetermined highest ranking card of numerical value and suit in any of said flows.

16. A method according to claim 15, further comprising:

allowing an unawarded one of said bonus pots to remain in said bonus pot location for award in a subsequent card table game.

17. A method according to claim 1, further comprising:

requiring said player to withdraw from playing said flow if said main pot raise of said player is not equal to or greater than a prior one of said main pot raises.

18. A method according to claim 1, wherein said predetermined quantity of said cards ranges from three to thirteen.

19. A method according to claim 1, wherein said initial pattern and said higher ranking pattern includes a quantity of said plurality of cards ranging from one to said predetermined quantity of said plurality of cards.

20. A method according to claim 1, wherein said initial pattern and said higher ranking pattern is selected from a predetermined list of patterns.

* * * * *